US008864270B2

(12) United States Patent
Biglari et al.

(10) Patent No.: US 8,864,270 B2
(45) Date of Patent: Oct. 21, 2014

(54) METHOD TO EXECUTE A PAUSE FUNCTION DURING PRINTING OPERATION IN AN INK PRINT APPARATUS

(71) Applicants: Mehrad Biglari, Munich (DE); Admir Lela, Haar (DE); Peter Thiemann, Munich (DE)

(72) Inventors: Mehrad Biglari, Munich (DE); Admir Lela, Haar (DE); Peter Thiemann, Munich (DE)

(73) Assignee: Océ Printing Systems GmbH, Poing (DE)

( * ) Notice: Subject to any disclaimer, the term of this patent is extended or adjusted under 35 U.S.C. 154(b) by 129 days.

(21) Appl. No.: 13/633,193

(22) Filed: Oct. 2, 2012

(65) Prior Publication Data

US 2013/0100194 A1 Apr. 25, 2013

(30) Foreign Application Priority Data

Oct. 21, 2011 (DE) ..... 10 2011 054 693

(51) Int. Cl.
*B41J 29/38* (2006.01)
*B41J 15/16* (2006.01)
*B41J 11/42* (2006.01)

(52) U.S. Cl.
CPC . *B41J 15/16* (2013.01); *B41J 11/42* (2013.01)
USPC ..... 347/16

(58) Field of Classification Search
CPC ..... B41J 2/0057; B41J 2/01; B41J 2/04508; B41J 2/0451; B41J 2/04563; B41J 2/0458; B41J 2/04581; B41J 2/04591; B41J 2/17546; B41J 2/17593; B41J 2/2114; B41J 2/2135; B41J 3/60; B41J 11/0015; B41J 11/0065; B41J 11/007; B41J 11/0085; B41J 11/0095; B41J 11/06; B41J 11/42; B41J 13/103; B41J 29/17; B41J 29/38; B41J 29/393; B41J 2002/012; B41J 2202/09; B41M 5/52; B41M 7/00; G02B 5/201; G02F 1/133516; B41F 13/02; B41F 13/025; B65H 23/0258; B65H 2301/4148; H05K 3/1216
USPC ..... 347/14, 16, 19, 101, 103, 104, 107; 101/DIG. 42
See application file for complete search history.

(56) References Cited

U.S. PATENT DOCUMENTS 3,869,983 A * 3/1975 Garber et al. ..... 101/137
7,191,973 B2 3/2007 Gretsch et al.

(Continued)

FOREIGN PATENT DOCUMENTS

EP 0788882 B1 7/2002
WO 03066492 A1 8/2003

*Primary Examiner* — Manish S Shah
*Assistant Examiner* — Roger W Pisha, II
(74) *Attorney, Agent, or Firm* — Schiff Hardin LLP

(57) ABSTRACT

In a method to execute a pause function of an ink printing system wherein a printing substrate web is printed with a printing unit with print bars having print heads, a real value of a web tension of the printing substrate web is measured with a web tension sensor. In a printing operation the real value of the web tension is regulated to a predetermined desired operating value of the web tension. With triggering of the pause function, the web tension is further regulated by modifying the desired value of the web tension so that the printing substrate web assumes a position at the print heads after an end of the pause function that it had before a beginning of the pause function. After the end of the pause function, the real value of the web tension is regulated again to the desired operating value of the web tension.

8 Claims, 4 Drawing Sheets

(56) References Cited

U.S. PATENT DOCUMENTS

2003/0079629 A1* 5/2003 Albert et al. ..... 101/228
2007/0051264 A1 3/2007 Sakamoto
2007/0059077 A1* 3/2007 Silverbrook et al. ..... 400/614
2009/0020641 A1* 1/2009 Loddenkoetter ..... 242/416
2010/0230527 A1* 9/2010 Ray ..... 242/538.1
2011/0025743 A1* 2/2011 Mizes ..... 347/14
2011/0149004 A1* 6/2011 Ray et al. ..... 347/104

* cited by examiner

METHOD TO EXECUTE A PAUSE FUNCTION DURING PRINTING OPERATION IN AN INK PRINT APPARATUS

BACKGROUND

Ink printing apparatuses can be used for single or multicolor printing of a printing substrate web, for example a belt shaped recording medium made of the most varied materials (for example paper). The design of such ink printing apparatuses is known, see for example EPO 788882 B1. Ink printing apparatuses that operate according to the drop-on-demand (DoD) principle have a print head or multiple print heads with nozzles comprising ink channels, the activators of which nozzles—controlled by a printer controller—excite ink droplets in the direction of the printing substrate web, which ink droplets are deflected onto the printing substrate web in order to apply printing dots there for a print image. The activators can generate ink droplets thermally (bubble jet) or piezoelectrically.

In the printing of a printing substrate web it is sometimes necessary to halt the printing substrate web during the printing operation in a pause function, for example in order to monitor the register quality after printing a print job, or to correct problems in the post-processing of the printing substrate web. After running up the printing substrate web again, print image disruptions can then occur at those web segments that were located directly under the printing nozzle after activation of the pause function. Due to the relatively large transfer printing zone in ink printing apparatuses (for example inkjet printing systems), in particular in color printing, the print image disruptions that occur due to the pause cause a correspondingly large amount of spoilage. The occurring print image defects include print image distortions or color register errors. The causes for these are the swelling or shrinking of the printing substrate web during the pause and, connected with this, the position shifts of the printing substrate web below the printing heads.

These problems are explained using FIG. 1. A printing unit 1 and a printer controller 2 of a printing apparatus DR are shown. Arranged along a printing substrate web 3 is a printing unit 1 that has print bars 4 with print heads 5 one after another as viewed in the transport direction of the printing substrate web 3. In color printing, for example, a respective print bar 4 can be provided per color to be printed. The printing substrate web 3 is moved past the print bars 4 with the aid of a take-off roller 9. The printing substrate web 3 is thus situated on a saddle with guide rollers 8. Arranged at the input of the printing unit 1 is a rotary encoder roller 6 that is driven by the printing substrate web 3 and that generates rotary encoding pulses depending on the feed movement of the printing substrate web 3, which pulses are supplied to the printer controller 2 and are used by the printer controller 2 in order to establish the point in time of the triggering of the printing process at the individual print heads 5. The printing substrate web 3 is supplied to the rotary encoder roller 6 via a drive roller 7 arranged before the rotary encoder roller 6.

In FIG. 1 it is shown in principle how the printing substrate web 3 can be affected by the printing unit 1 or the environment air in individual web segments BA through the printing apparatus DR, for example given a downtime of the printing apparatus DR. In the web segment BA1 between drive roller 7 and rotary encoder roller 6, the printing substrate web 3 is exposed to the environment air, with the result that here a swelling of the printing substrate web 3 can occur due to the humidity of the environment air. However, the change to the printing substrate web 3 in the longitudinal direction that is caused by this is compensated with the aid of the rotary encoder roller 6. In the web segment BA2 after the rotary encoder roller 6 and up to the printing unit 1, a swelling of the printing substrate web 3 can occur due to the environment air, this swelling is not taken into account by the rotary encoder roller 6, however. This also applies to the web segment BA3 below the print heads 5 of the printing unit 1. There the printing substrate web 3 can shrink due to the operating temperature of the print heads 5; however, the printing substrate web 3 is also exposed to the environment air, such that—in particular given larger distances between the print bars 5—the web segment BA3 can swell due to the moisture in the environment air. Both influences overlap. The printing substrate web 3 is thus exposed to different environmental influences from the driver roller 7 up to the take-off roller 9, which can lead to either a shrinking or a swelling of the printing substrate web 3. This can lead to the aforementioned print image errors, in particular if the printing process is restarted after a pause during the printing operation.

Upon triggering the pause function, the following effects on the printing substrate web 3 are thus to be considered:

- a temperature and moisture difference between the printing substrate web 3 and the environment air, with the swelling or shrinking of the printing substrate web 3 that is concurrent with this; and
- a temperature difference between the print heads 5 and the printing substrate web 3, with the shrinking of the printing substrate web 3 that is concurrent with this.

SUMMARY

It is an object to specify a method in which, after triggering a pause function, the unwanted influences of the temperature and the environment air on the printing substrate web (and therefore on the print image) are minimized, in particular after ending a printing pause.

In a method to execute a pause function of an ink printing system wherein a printing substrate web is printed with a printing unit with print bars having print heads, a real value of a web tension of the printing substrate web is measured with a web tension sensor. In a printing operation the real value of the web tension is regulated to a predetermined desired operating value of the web tension. With triggering of the pause function, the web tension is further regulated by modifying the desired value of the web tension so that the printing substrate web assumes a position at the print heads after an end of the pause function that it had before a beginning of the pause function. After the end of the pause function, the real value of the web tension is regulated again to the desired operating value of the web tension.

DESCRIPTION OF PREFERRED EXEMPLARY EMBODIMENT

Figure 1:
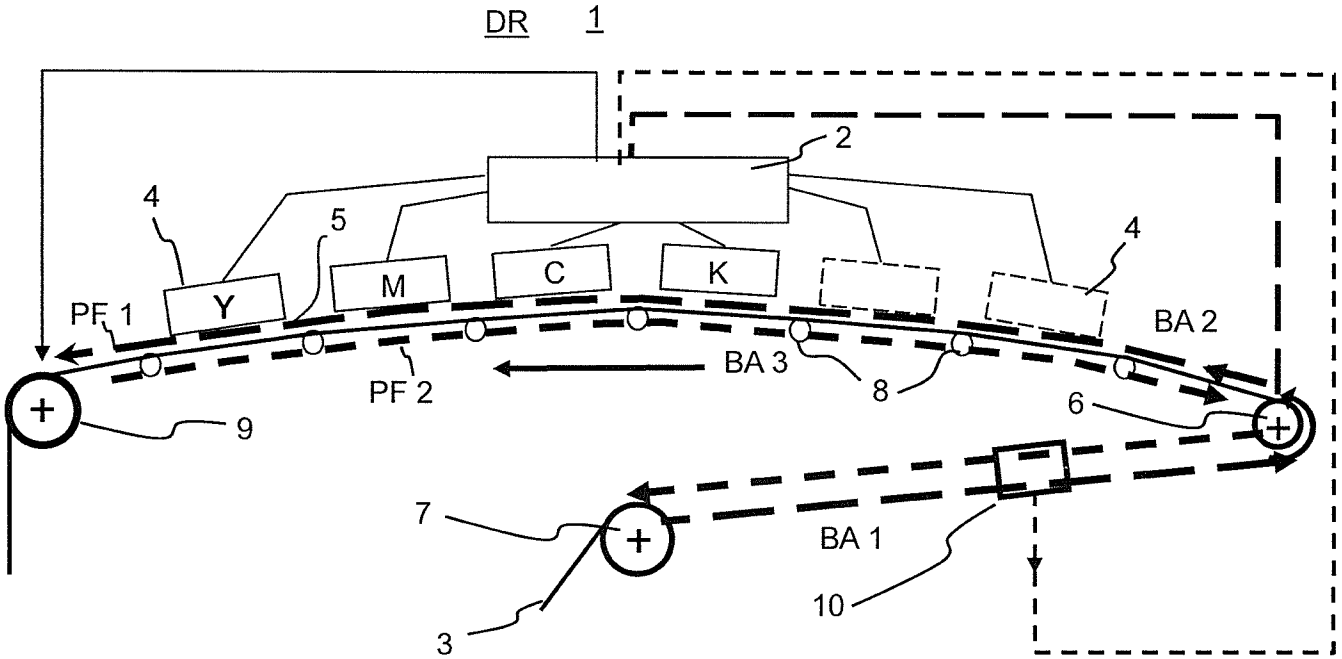
FIG. 1 is a principle representation of a printing unit of an ink printing apparatus.

For the purposes of promoting an understanding of the principles of the invention, reference will now be made to a preferred exemplary embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

According to the exemplary embodiment, a real value of web tension of the printing substrate web is measured with a web tension sensor, and the real value of the web tension is regulated to a predetermined desired value of the web tension (called a desired operating value in the following) of the printing substrate web. This regulation of the web tension of the printing substrate web also takes place during a printing pause. With triggering of the pause function, the desired value of the web tension of the printing substrate web is altered, starting from the desired operating value, so that after the end of the pause the printing substrate web assumes the position at the print heads that it had assumed before the beginning of the pause. After the end of the pause, the real value of the web tension of the printing substrate web is regulated to the desired operating value of the web tension again.

If a swelling of the printing substrate web occurs during the printing pause, the desired value of the web tension decreases after triggering the pause function. Conversely, the desired value of the web tension increases after triggering the pause function if a shrinking of the printing substrate web occurs during the printing pause.

An advantage of the method according to the exemplary embodiment lies in that, after ending the pause, a web segment of the printing substrate web that was situated under the print heads before the pause lies below the printing unit. This result is achieved solely with the printer controller used to regulate the web tension of the printing substrate web, such that no additional components are required.

The exemplary embodiment is shown in drawing figures.

Figure 2:
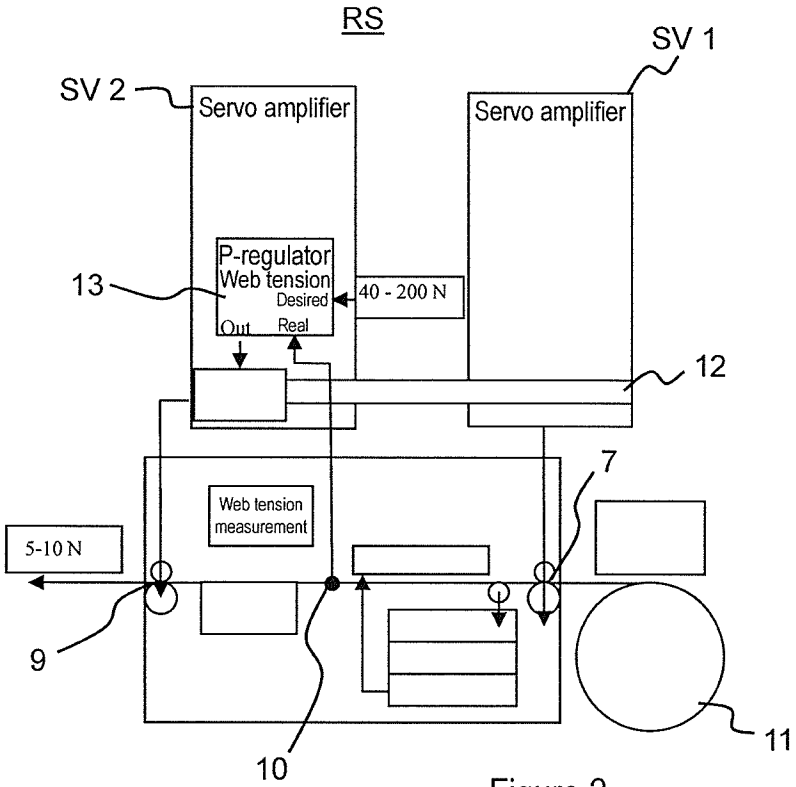
FIG. 2 is a principle representation of a control circuit arranged in a printer controller, which control circuit regulates the transport of the printing substrate web through the printing apparatus.

According to FIG. 1, the printing apparatus DR additionally has a web tension sensor 10 that is arranged adjacent to the printing substrate web 3, for example between the drive roller 7 and the rotary encoder roller 6. During printing operation, the real value of the web tension of the printing substrate web 3 that is determined by the web tension sensor 10 is compared with a predetermined desired value of the web tension (the desired operating value) and—given deviation of the real value from the desired value—the web tension of the printing substrate web 3 can be regulated again to the desired operating value, for example by influencing the rotation speed of the take-off roller 9. The control circuit capital RS that is required for this can be arranged in the printer controller 2. FIG. 2 shows an exemplary embodiment of a control circuit RS in a block diagram. Only the path of the printing substrate web 3 through the printing unit 1 and the control circuit RS are shown here. The printing substrate web 3 is drawn from a supply roll 11 by the drive roller 7. For this the drive roller 7 is controlled by a regulated first servo amplifier SV1 in the control circuit RS. The take-off roller 9 is likewise driven by a regulated second servo amplifier SV 2 in the control circuit RS; for example, this is coupled via an electronic shaft 12 with the first servo amplifier SV 1 so that the take-off roller 9 is synchronized with the drive roller 7.

In the exemplary embodiment, the real value of the web tension, measured by the web tension sensor 10, is now related to the second servo amplifier SV 2 to which the desired value of the web tension is also supplied. The regulator 13 comprised in the second servo amplifier SV 2 now regulates the real value of the web tension to its desired value. This desired value is the predetermined desired operating value matched to the printing operation. For example, if the real value of the web tension is too low, the take-off roller 9 is accelerated until the desired value of the web tension of the printing substrate web 3 is achieved. The same accordingly applies if the real value of the web tension is too high; here the rotation speed of the take-off roller 9 is reduced until the desired value of the web tension has appeared.

In the exemplary embodiment, the drive roller 7 is the master drive; the take-off roller 9 follows the driver roller 7 in slave operation. However, the take-off roller 9 can also be used as a master driver, the drive roller 7 can operate in slave operation, and the regulator for the web tension can be arranged in the first servo amplifier SV1.

If the printing operation transitions into a pause, the initially illustrated problems occur. For example, the printing substrate web 3 can swell during the pause if it is exposed to moisture, or it can shrink if it is exposed to heat.

In the first case, given swelling of the printing substrate web 3 in the printing pause the web tension decreases. Since the control circuit RS continues to be operational, during the printing pause the web tension of the printing substrate web 3 would again be brought to the desired operating value during operation without use of the exemplary embodiment, and the printing substrate web 3 is moved forwards from the take-off roller 9 (arrow PF1 in FIG. 1).

In the second case, given shrinkage of the printing substrate web 3 in the printing pause the web tension increases. Here the web tension of the printing substrate web 3 would be reduced by the control circuit RS during the printing pause without using the exemplary embodiment, until the desired operating value of the web tension is achieved and the printing substrate web 3 moves backwards from the take-off roller 9 (arrow PF2 opposite arrow PF1 in FIG. 1).

In both cases, during the pause the printing substrate web 3 is moved with the result that, after the end of the pause, the position of the printing substrate web 3 relative to the print heads 5 has changed in comparison to the position of the printing substrate web 3 before the pause. The result is that the print dots generated by print heads 5 that print the printing substrate web 3 after the pause are shifted relative to the desired position of these print dots, such that print image errors occur.

In order to avoid these print image errors, according to the exemplary embodiment the desired value of the web tension (at the drive unit that regulates the web tension) is changed at the beginning of the pause, starting from the desired operating position, so that the position of the printing substrate web 3 under the print heads 5 after the end of the pause corresponds to their position before the beginning of the pause.

Figure 3:
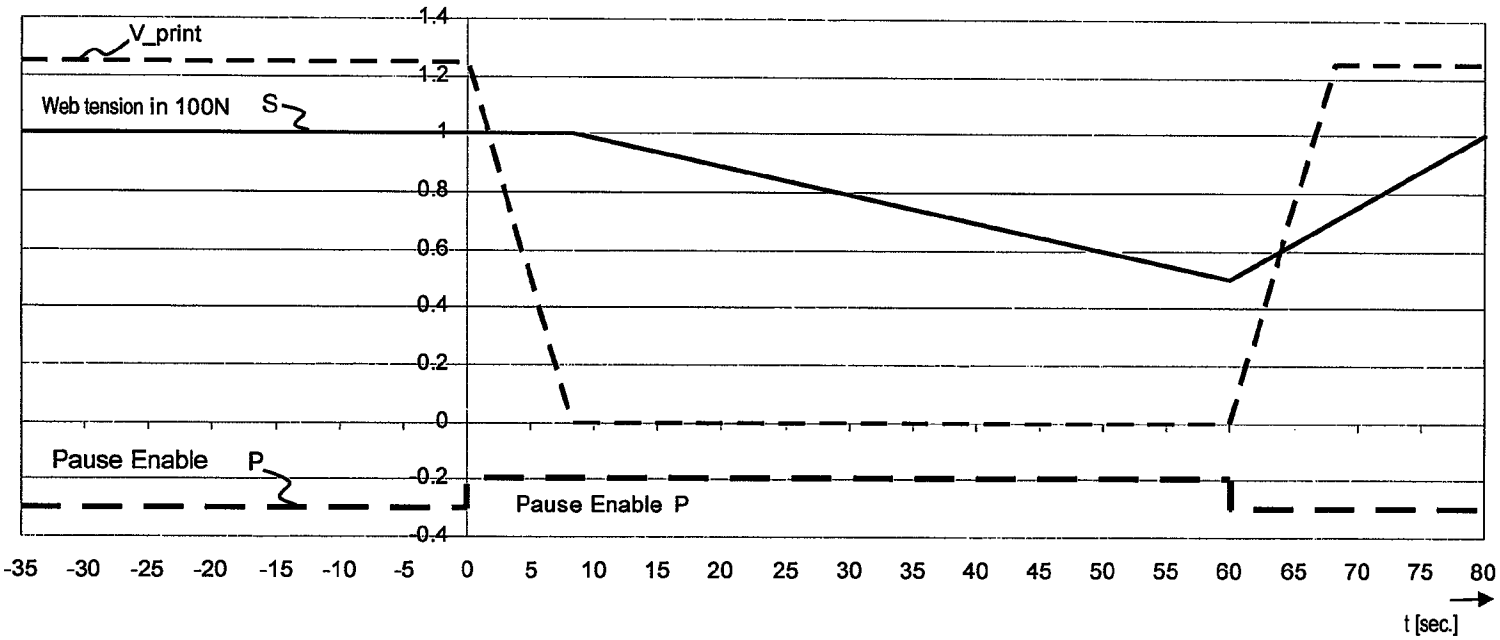
FIGS. 3 and 4 are diagrams that depict a dependency of feed velocity v of the printing substrate web and web tensions of the printing substrate web versus time t.

In the first case (swelling of the printing substrate web 3), the desired value of the web tension is decreased by such an amount from the desired operating value (starting at the beginning of the pause), and the regulator 13 is affected, so that the position of the printing substrate web 3 coincides after the end of the pause with the position of the printing substrate web 3 that existed before the beginning of the pause. The extension of the printing substrate web 3 that was generated by the swelling then does not lead to a shift of the position of the printing substrate web 3 after the end of the pause. The take-off roller 9 tensions the printing substrate web 3 such that the extension due to the swelling is compensated after the course of the pause. An example of this case can be learned from FIG. 3. Shown in FIG. 3 over time t are the velocity v of the printing substrate web 3, the web tension s or the web tension of the printing substrate web 3 and the pause clock p. At the beginning of the pause, the velocity v of the printing substrate web 3 is driven back to zero. If the printing substrate web 3 is halted, the swelling of the printing substrate web 3 due to the moisture begins. The desired value of the web tension (and therefore the regulation of the web tension) is simultaneously reduced by such an amount that the position of the printing substrate web 3 after the end of the pause corresponds to the position that the printing substrate web 3 had taken up before the beginning of the pause. After the end of the pause, the desired value of the web tension is increased again to the desired operating value.

Figure 4:
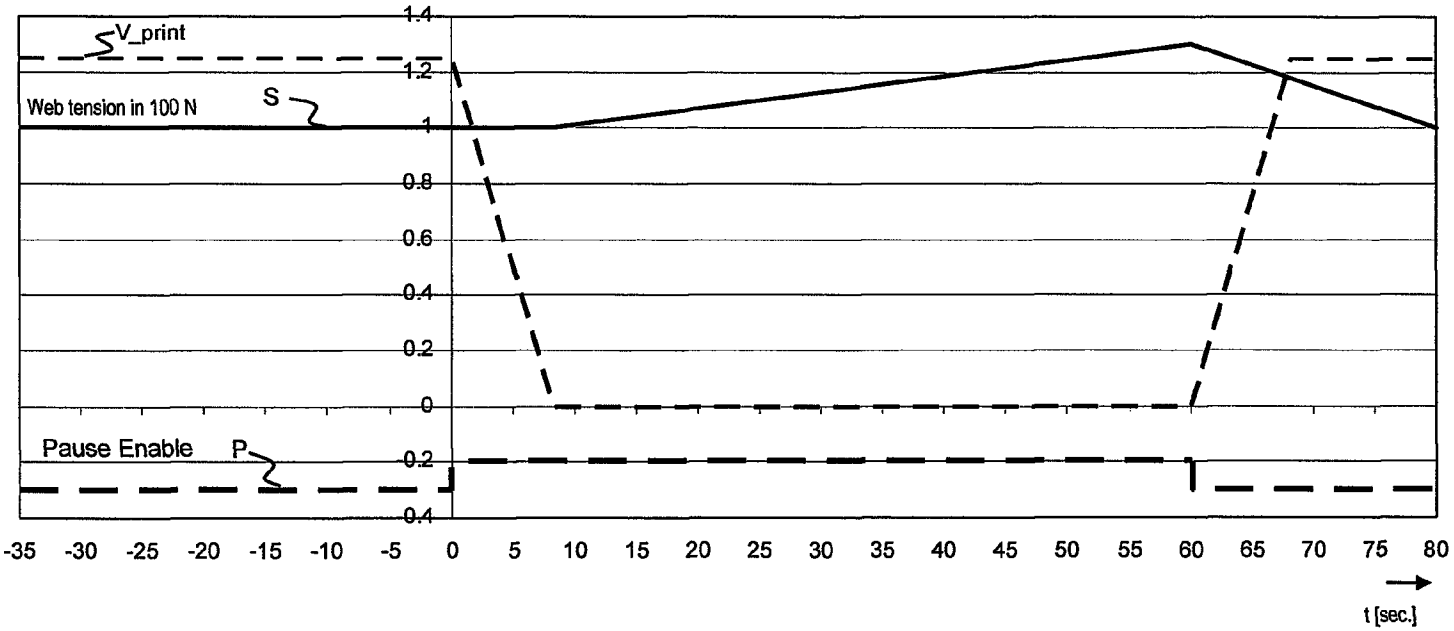

FIG. 4 shows the relationships given a shrinking due to a temperature increase of the printing substrate web 3. Here the velocity v of the printing substrate web 3, the web tension s and the pause signal p are again shown over time t. Since the printing substrate web 3 shrinks during the pause due to a temperature increase, the desired value of the web tension increases by such an amount that—via the regulation of the web tension of the printing substrate web 3 by the regulator 13—the printing substrate web 3 takes up the position upon restarting the printing process that it had occupied before the beginning of the pause. Printing errors are therefore precluded.

A comparable result can then be achieved if, in the first case, the desired value of the web tension of the printing substrate web 3 is increased before triggering the pause and the desired value of the web tension is set at the desired operating value during the pause.

The same accordingly applies to the second case. Here, before triggering the pause the desired value of the web tension of the printing substrate web 3 is decreased and, during the pause, the desired value of the web tension is set to the desired operating value.

The dependency of the length change of a printing substrate web 3 on the humidity or on the temperature per type of printing substrate web 3 is known or—in the case of operation—can be determined via measurement per printing apparatus and type of the printing substrate web, and the desired values of the web tension can be associated with these measurement values. These desired values can then be stored in the control circuit RS and, depending on the type of printing substrate web 3 that is used in the printing operation, can be supplied as a desired value of the web tension to (for example) the regulator 13 of the take-off roller 9 upon triggering of the pause function.

Although a preferred exemplary embodiment is shown and described in detail in the drawings and in the preceding specification, it should be viewed as purely exemplary and not as limiting the invention. It is noted that only preferred exemplary embodiment is shown and described, and all variations and modifications that presently or in the future lie within the protective scope of the invention should be protected.

We claim as our invention:

1. A method to execute a pause function during printing operation of an ink printing system with at least one printing apparatus, wherein a printing substrate web is printed with a printing unit with print bars having print heads, comprising the steps of:

measuring a real value of a web tension of the printing substrate web with a web tension sensor;

in the printing operation, regulating the real value of the web tension to a predetermined desired operating value of the web tension of the printing substrate web;

with triggering of the pause function, the web tension of the printing substrate web is further regulated by modifying the desired value of the web tension of the printing substrate web such that a displacement of the printing substrate web in proportion to a position of the print heads due to a length change of the printing substrate web during the pause function is compensated so that the printing substrate web assumes a position at the print heads after an end of the pause function that it had before a beginning of the pause function; and after the end of the pause function, regulating the real value of the web tension of the printing substrate web again to said desired operating value of the web tension of the printing substrate web.

2. The method according to claim 1 in which, if a swelling of the printing substrate web occurs, the desired value of the web tension of the printing substrate web is decreased relative to the desired operating value after the triggering of the pause function.

3. The method according to claim 1 in which the desired value of the web tension of the printing substrate web is increased relative to the desired operating value before the triggering of the pause function in order to compensate for a length change of the printing substrate web due to the swelling, and wherein the web tension is regulated again to the desired operating value after entering the pause function.

4. The method according to claim 1 in which, after the triggering of the pause function, the desired value of the web tension is increased relative to the desired operating value if a shrinking of the printing substrate web occurs during the pause function.

5. The method according to claim 1 in which, before the triggering the pause function, the desired value of the web tension of the printing substrate web is decreased relative to the desired operating value in order to compensate for a length change of the printing substrate web due to a shrinking, and in which the web tension is regulated again to the desired operating value after entering the pause function.

6. The method according to claim 1 in which a transport of the printing substrate web through the printing unit is regulated by a control circuit, wherein the control circuit controls a take-off roller arranged at an output of the printing unit such that the web tension of the printing substrate web assumes the predetermined desired operating value during the printing operation and in the printing pause function.

7. A method to execute a pause function during printing operation on a printing substrate web printed with a printing unit with print bars having print heads, comprising the steps of:

measuring a real value of a web tension of the printing substrate web with a web tension sensor;

in the printing operation, regulating the real value of the web tension to a predetermined desired operating value of the web tension;

with triggering of the pause function, modifying the desired value of the web tension such that a displacement of the printing substrate web in proportion to a position of the print heads due to a length change of the printing substrate web during the pause function is compensated so that the printing substrate web assumes a position at the print heads after an end of the pause function that it had before a beginning of the pause function; and after the end of the pause function, regulating the real value of the web tension to said desired operating value of the web tension.

8. A method to execute a pause function during printing operation on a printing substrate web printed with a printing unit with print bars having print heads, comprising the steps of:

measuring a real value of a web tension of the printing substrate web with a web tension sensor;

in the printing operation, regulating the real value of the web tension to a predetermined desired operating value of the web tension;

with triggering of the pause function, the web tension is further regulated by modifying the desired value of the web tension so that the printing substrate web assumes a position at the print heads after an end of the pause function that it had before a beginning of the pause function;

after the end of the pause function, regulating the real value of the web tension to said desired operating value of the web tension;

if a swelling of the printing substrate web occurs after the triggering of the pause function, the desired value of the web tension is decreased relative to the desired operating value; and if a shrinking of the printing substrate web occurs after the triggering of the pause function, the desired value of the web tension is increased relative to the desired operating value.

* * * * *